US008186896B2

(12) United States Patent
Frost et al.

(10) Patent No.: US 8,186,896 B2
(45) Date of Patent: May 29, 2012

(54) APPARATUS AND METHOD FOR PRINTING AND DISPENSING A WEB

(75) Inventors: Alexandre J. Frost, Simpsonville, SC (US); Gregory E. McDonald, Simpsonville, SC (US); Jason G. Verrett, Simpsonville, SC (US); H. Dean Conner, Mauldin, SC (US); Julian L. Pruitt, Greer, SC (US)

(73) Assignee: Cryovac, Inc., Duncan, SC (US)

( * ) Notice: Subject to any disclaimer, the term of this patent is extended or adjusted under 35 U.S.C. 154(b) by 1152 days.

(21) Appl. No.: 11/901,835

(22) Filed: Sep. 19, 2007

(65) Prior Publication Data

US 2009/0023569 A1 Jan. 22, 2009

Related U.S. Application Data

(60) Provisional application No. 60/959,632, filed on Jul. 16, 2007.

(51) Int. Cl.
*B41J 15/18* (2006.01)
*B41J 15/22* (2006.01)

(52) U.S. Cl. ..... 400/607; 400/605; 400/609; 101/288; 53/411; 53/131.4

(58) Field of Classification Search ..... 400/605, 400/607, 608.2, 608.4, 609; 101/228, 288; 493/187, 188; 53/411, 131.4, 571, 131.2, 53/64, 459, 570, 168, 131.5; *B41J 15/18, B41J 15/22*

See application file for complete search history.

(56) References Cited

U.S. PATENT DOCUMENTS

| | | | | |
|---|---|---|---|---|
| 2,295,327 | A | 9/1942 | Bendz | 226/40 |
| 2,750,679 | A | 6/1956 | Cohn et al. | 34/444 |
| 2,797,086 | A | 6/1957 | Cohn et al. | 226/26 |
| 3,004,728 | A | 10/1961 | Ihle | 242/534 |
| 3,161,347 | A | 12/1964 | Hannon | 229/69 |
| 3,270,931 | A | 9/1966 | Ried et al. | 226/49 |

(Continued)

FOREIGN PATENT DOCUMENTS

DE 2036004 1/1972

(Continued)

OTHER PUBLICATIONS

Office Action, mailed Jun. 24, 2008, in co-pending U.S. Appl. No. 11/333,569 (11 pages).

(Continued)

*Primary Examiner* — Judy Nguyen
*Assistant Examiner* — Jennifer Simmons
(74) *Attorney, Agent, or Firm* — Mark B. Quatt

(57) ABSTRACT

An apparatus for dispensing a web from a plurality of rolls of serrated bags, includes first and second web printer/web feeders, each adapted to advance and print first and second webs from a first and second roll of serrated bags respectively, the first and second web printer/web feeders including a first and second printer, and a first and second set of nip rollers respectively; first and second accumulator guide plates located downstream of the first and second printers; a set of dispensing nip rollers located downstream of the first and second accumulator guide plates; a web accumulation area; a web sensor for sensing an end of the first or second web; a first and second seal sensing device; a dispensing guide plate located downstream of the web sensor; and a bag handling mechanism for advancing a leading bag to a bag loader.

18 Claims, 13 Drawing Sheets

U.S. PATENT DOCUMENTS

| | | | | | |
|---|---|---|---|---|---|
| 3,286,005 | A | | 11/1966 | Cook | 264/563 |
| 3,487,986 | A | | 1/1970 | Nelson et al. | 226/42 |
| 3,587,843 | A | | 6/1971 | Wing | 206/460 |
| 3,701,318 | A | | 10/1972 | Lozeau et al. | 101/336 |
| 3,724,167 | A | | 4/1973 | Pizmoht | 53/390 |
| 3,733,128 | A | | 5/1973 | Naumann et al. | 355/45 |
| 3,776,081 | A | * | 12/1973 | Becker | 83/272 |
| 3,789,714 | A | | 2/1974 | Demny | 83/272 |
| 3,837,549 | A | | 9/1974 | Sengewald | 225/11 |
| 3,873,012 | A | | 3/1975 | Wick et al. | 226/44 |
| 3,890,547 | A | | 6/1975 | Keck | 318/6 |
| 4,015,452 | A | | 4/1977 | Kreitz | 68/175 |
| 4,021,287 | A | | 5/1977 | Martin | 156/497 |
| 4,106,261 | A | | 8/1978 | Greenawalt | 53/449 |
| 4,120,134 | A | | 10/1978 | Scholle | 53/434 |
| 4,172,565 | A | | 10/1979 | Zaffarano | 242/413.3 |
| 4,179,055 | A | | 12/1979 | Milner | 225/80 |
| 4,341,586 | A | | 7/1982 | Koutonen | 156/518 |
| 4,505,092 | A | | 3/1985 | Bowers et al. | 53/504 |
| 4,512,138 | A | | 4/1985 | Greenawalt | 53/451 |
| 4,516,385 | A | | 5/1985 | Lenker et al. | 53/504 |
| 4,534,253 | A | * | 8/1985 | Seragnoli | 83/336 |
| 4,616,472 | A | | 10/1986 | Owensby et al. | 53/459 |
| 4,825,622 | A | | 5/1989 | Nigg | 53/203 |
| 4,834,697 | A | | 5/1989 | Osborn | 493/193 |
| 4,834,698 | A | | 5/1989 | Osborn | 493/193 |
| 5,024,042 | A | | 6/1991 | Meyer | 53/168 |
| 5,115,626 | A | | 5/1992 | Rutter et al. | 53/468 |
| 5,186,707 | A | | 2/1993 | Barta | 493/439 |
| 5,327,704 | A | | 7/1994 | Hoekzema et al. | 53/459 |
| 5,328,438 | A | | 7/1994 | Crowley | 493/187 |
| 5,443,606 | A | | 8/1995 | Hassenboehler, Jr. et al. | 55/486 |
| 5,474,208 | A | | 12/1995 | Ball | 221/1 |
| 5,655,356 | A | | 8/1997 | Ginestra et al. | 53/504 |
| 5,707,024 | A | | 1/1998 | Mellquist et al. | 242/418.1 |
| 5,816,990 | A | | 10/1998 | Melville | 452/157 |
| 5,899,406 | A | | 5/1999 | Payne | 242/552 |
| 5,979,841 | A | | 11/1999 | Piraneo et al. | 248/95 |
| 5,987,854 | A | | 11/1999 | Killinger et al. | 53/459 |
| RE36,759 | E | | 7/2000 | Hoover et al. | 156/147 |
| 6,267,661 | B1 | | 7/2001 | Melville | 452/157 |
| 6,470,648 | B1 | * | 10/2002 | Baker | 53/411 |
| 6,612,097 | B2 | | 9/2003 | O'Connor | 53/429 |
| 6,649,262 | B2 | | 11/2003 | Hoo et al. | 428/364 |
| 6,651,924 | B2 | | 11/2003 | Gingras et al. | 242/541.2 |
| 6,663,905 | B1 | | 12/2003 | Ennis et al. | 426/129 |
| 6,688,346 | B2 | | 2/2004 | Brahier et al. | 141/314 |
| 6,817,566 | B2 | | 11/2004 | Clifford et al. | 242/552 |
| 6,857,455 | B2 | * | 2/2005 | Brahier et al. | 141/314 |
| 6,932,751 | B1 | | 8/2005 | Ward et al. | 493/25 |
| 6,955,029 | B2 | | 10/2005 | Palumbo | 53/469 |
| 7,073,902 | B2 | | 7/2006 | Codos et al. | 347/102 |
| 7,607,467 | B2 | | 10/2009 | McDonald et al. | 156/510 |
| 2004/0154689 | A1 | | 8/2004 | Brahier et al. | 141/10 |

FOREIGN PATENT DOCUMENTS

| | | |
|---|---|---|
| GB | 1094805 | 12/1967 |
| WO | WO 02/072354 A1 | 9/2002 |

OTHER PUBLICATIONS

Office Action, mailed Jan. 13, 2009, in co-pending U.S. Appl. No. 11/333,569 (11 pages).

Office Action (Interview Summary), mailed Apr. 6, 2009, in co-pending U.S. Appl. No. 11/333,569 (4 pages).

Notice of Allowance and Notice of Allowability, mailed May 14, 2009 (12 pages).

Notice of Allowance and Notice of Allowability, mailed Sep. 3, 2009 (6 pages).

International Search Report (2 pages) for International Application No. PCT/US2008/008161, dated Sep. 12, 2008.

Notification Concerning Transmittal of International Preliminary Report on Patentability (5 pages) for International Application No. PCT/US2008/008161, dated Jan. 28, 2010.

Tandematic®, Web Storage System, Tandematic®, Apr. 12, 2005, 2 pages.

* cited by examiner

APPARATUS AND METHOD FOR PRINTING AND DISPENSING A WEB

This application claims the benefit of U.S. Provisional Application Ser. No. 60/959,632 filed Jul. 16, 2007, the contents of which are hereby incorporated by reference.

FIELD OF THE INVENTION

The present invention relates to an apparatus and method for selectively dispensing and printing a web from a plurality of rolls of serrated bags.

BACKGROUND OF THE INVENTION

Many packaging applications, especially food packaging, require or benefit from the use of bags made from various thermoplastic materials and structures.

These bags are commonly used in large scale meat processing and/or packaging systems where production speed and efficiency are important. Bags to be used in these systems are often themselves packed in boxes, the individual bags taped together so that they will feed in a predictable and efficient manner to an article loading station. Typical of such technology is U.S. Pat. No. 3,161,347 (Hannon), disclosing a tape to which bags are attached, and U.S. Pat. No. 3,587,843 (Wing), disclosing two tapes to which are attached imbricated (i.e. shingled) bags.

At the loading station of a conventional system, each bag is opened and then loaded with an article such as a fresh red meat subprimal or smoked and processed meat, poultry, cheese, or other perishable food product, or other product.

Alternatively, bags can be provided in a roll, with adjoining bags connected by a transverse line of serrations.

In some packaging environments, such as the packaging of various cuts of fresh red meat, individual meat cuts can vary significantly in size. If pre-made bags are used to package these individual cuts, it may be necessary to have on hand bags of different dimensions, e.g. width and/or length, to accommodate the variability in product size.

Copending U.S. patent application Ser. No. 11/333,569 filed on 17 Jan., 2006, entitled "Web Dispenser", this application is incorporated herein by reference in its entirety. discloses an apparatus for selectively dispensing a web from a plurality of rolls of serrated bags or layflat tubing including a web selector for selecting and advancing a web from the plurality of rolls; a bag driver for advancing the selected web and separating a bag from the web; and a bag handling mechanism for transporting the separated bag from the bag driver to a location for processing. A sealer/cutter is used to produce a bag from the layflat tubing. A method of selectively dispensing a web from a plurality of rolls of serrated bags or layflat tubing includes selecting and advancing a web from the plurality of rolls of serrated bags; advancing the selected web and separating a bag from the web; and transporting the separated bag to a location for further processing. In the case of layflat tubing, the selected web is sealed and cut to make a bag.

It is desirable to provide an apparatus and method for selectively dispensing and printing a web from a plurality of rolls of serrated bags or lay-flat tubing.

SUMMARY OF THE INVENTION

In a first aspect, an apparatus for selectively dispensing a web from a plurality of rolls of serrated bags, each roll of bags having a series of bags connected by transverse serrations, comprises a first web printer/web feeder, adapted to advance and print a first web from a first roll of serrated bags, the first web printer/web feeder comprising a first printer, and a first set of nip rollers; a second web printer/web feeder, adapted to advance and print a second web from a second roll of serrated bags, the second web printer/web feeder comprising a second printer, and a second set of nip rollers, the second printer spaced apart from the first printer; first and second accumulator guide plates located downstream of the first and second printers, the second accumulator guide plate spaced apart from the first accumulator guide plate; a set of dispensing nip rollers located downstream of the first and second accumulator guide plates; a web accumulation area defined by the space between the first and second accumulator guide plates, and the set of dispensing nip rollers; a web sensor for sensing an end of the first web, or an end of the second web; a first seal sensing device for sensing a bag serration, seal; or tab of the first web; a second seal sensing device for sensing a bag serration, seal; or tab of the second web; a dispensing guide plate located downstream of the web sensor; and a bag handling mechanism for advancing a leading bag to a bag loader.

A method of selectively dispensing a web from a plurality of rolls of serrated bags, each roll of bags having a series of bags connected by transverse serrations, the method comprising selecting and advancing a first web from a first roll of serrated bags, the first web having a free end, and a leading bag with a serration therein; advancing the first web between a first set of nip rollers, the first set of nip rollers comprising a moveable nip roller and a driven anvil roller; printing indicia on the first web; advancing the printed web between first and second accumulator guide plates; drawing the printed web between a set of dispensing nip rollers located downstream of the first and second accumulator guide plates; sensing the web by a web sensor disposed near and downstream of the set of dispensing nip rollers; moving the moveable nip roller toward the driven anvil roller; trapping the first web between the moveable nip roller and the driven anvil roller; stopping the free end of the first web in a position below the set of dispensing nip rollers; advancing an additional length of the first web from the first roll of serrated bags; and accumulating the advanced web between the first and second accumulator guide plates, until a first seal sensing device, positioned upstream of the first set of nip rollers, has sensed a seal, serration, or tab, on the first web, and a sufficient length of the first web has advanced to ensure that a serration of a bag immediately upstream of the leading bag is disposed at a location downstream of the first set of nip rollers, but upstream of the set of dispensing nip rollers.

BRIEF DESCRIPTION OF THE DRAWINGS

In the drawings presented by way of illustration of the invention.

DETAILED DESCRIPTION OF THE INVENTION

The invention provides an apparatus and method for selectively printing, accumulating and dispensing a discrete web of perforated bags from a plurality of sources to a set of dispensing nip rollers, and then sequentially dispensing bags from the set of dispensing rollers to a bag handling mechanism. The bag handling mechanism can transferring each bag to conventional bag loading equipment.

"Web" herein refers to a leading portion of a roll of serrated bags in which the leading portion is advanced to interface with the apparatus of the invention and undergo one or more of the operations disclosed herein. Serrated bags are well known in the art. Serrated bags are typically in roll form, with adjacent bags attached by means of a set of serrations running transversely to the bags' longitudinal axis. These serrations allow each leading bag to be separated from the roll of bags as needed. Serrated bags each include a transverse seal at one end of the bag.

"Serration", "serrated" and the like herein refers to perforations, serrations, laser scoring, etc. that connect adjacent bags in a web or train of bags such that adjacent bags can be separated relatively easily along the line of the serration by manual or mechanical means. The serration can be made up of a plurality of holes extended in a straight or curved line across the respective bag, and extending through both plies or walls of the bag. In embodiments where the bags are patch bags, the serration will typically be present in a part of each bag where the patch is not present. Individual holes in the serration can be of any suitable size and geometry, and can be identical to one another or different from one another in dimension or geometry. The spaces between adjacent individual holes in the serration can all be of the same length, or alternatively the spaces between adjacent individual holes in the serration can differ in length.

"Accumulate" and the like herein refers to a web that is bunched up or gathered in a confined space.

"Seal sensing device" and the like herein refers to a device for sensing a bag serration, bag seal, or tab located on a bag of a web.

Although the embodiments disclosed herein are directed primarily with respect to serrated bags, those skilled in the art will understand that lay flat tubing can be beneficially used in connection with the present invention instead of serrated bags.

The Apparatus

Figure 1:
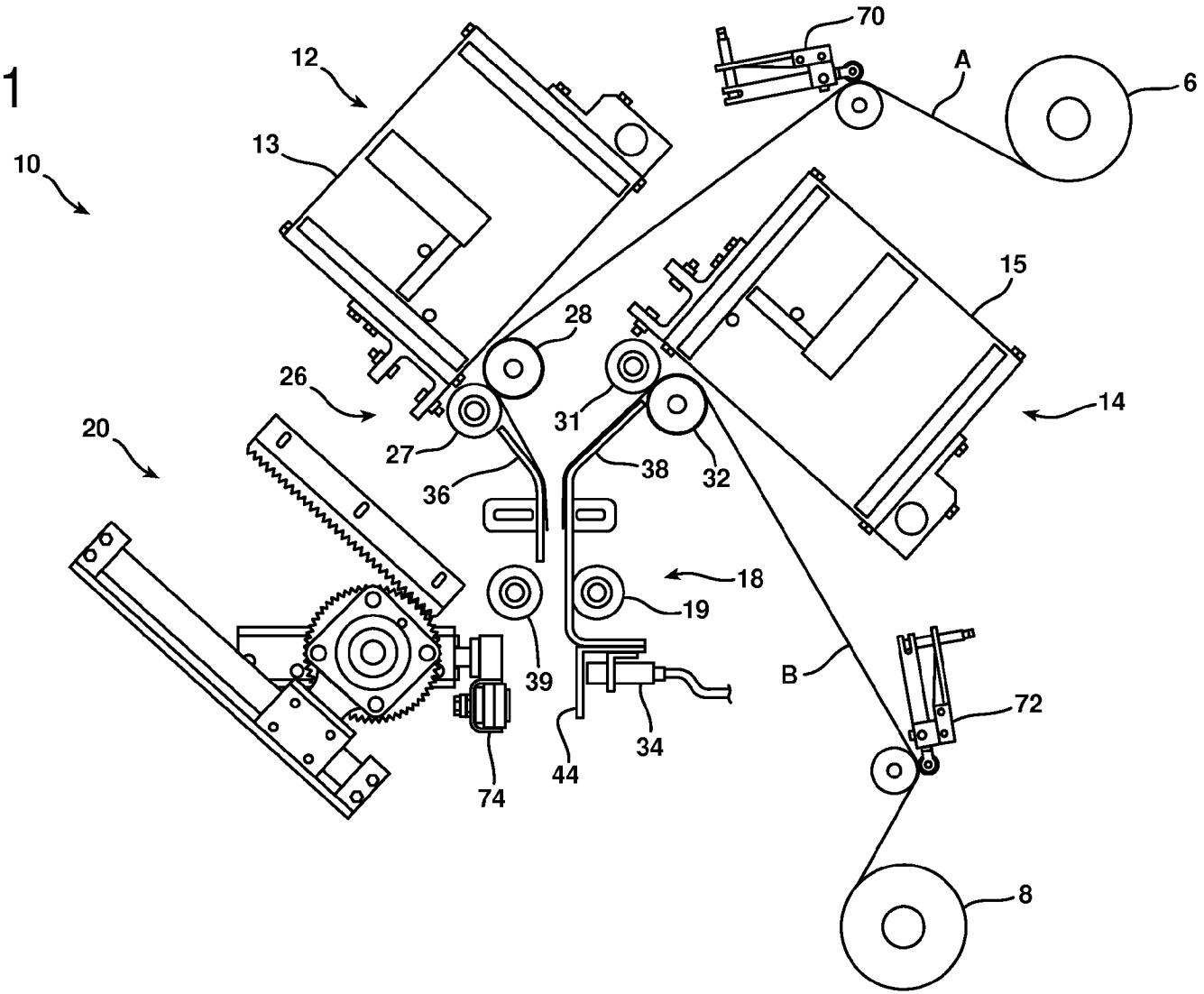
FIG. 1 is a schematic elevational view of an apparatus in accordance with one embodiment of the invention.
Figure 2:
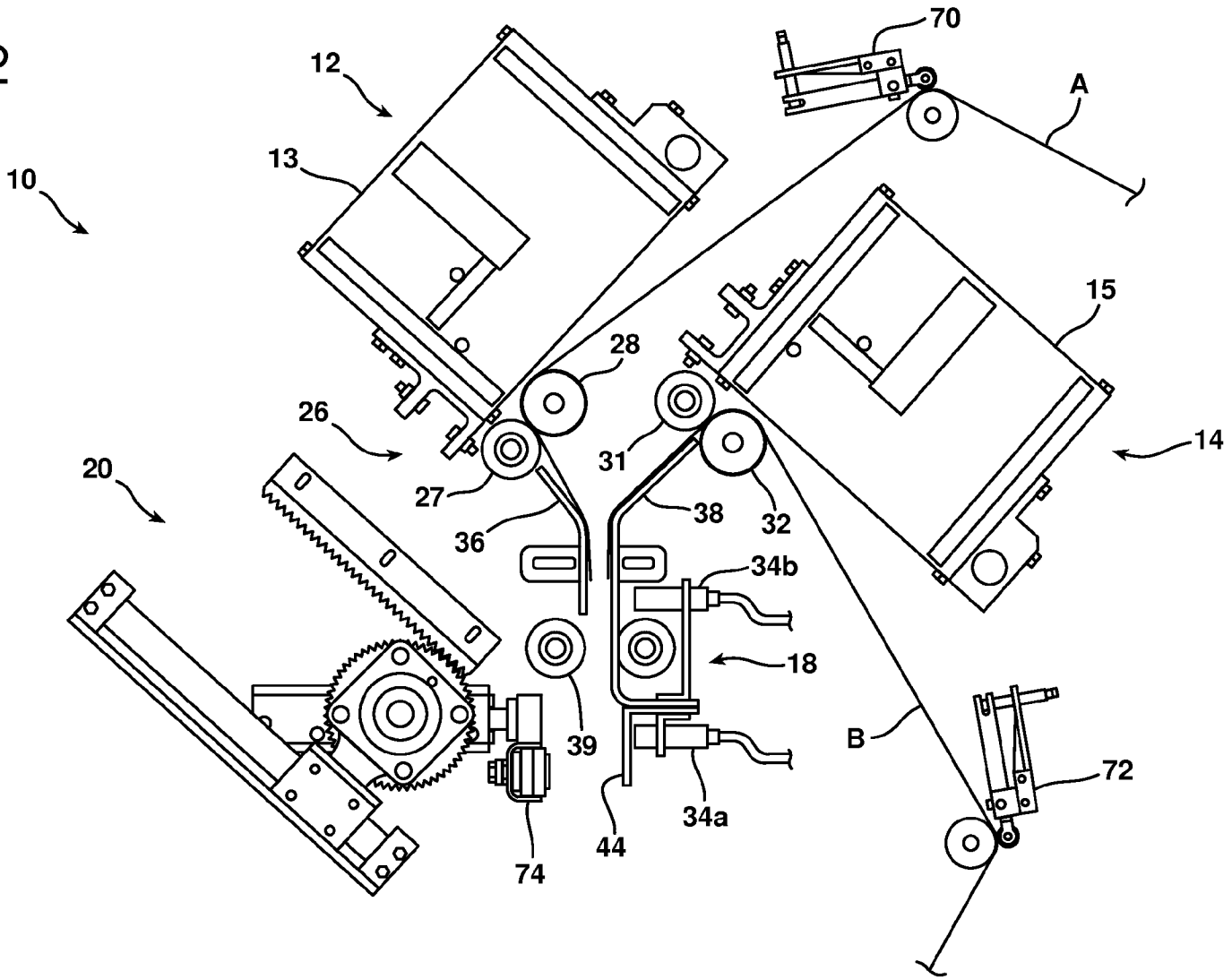
FIG. 2 is a schematic elevational view of an apparatus in accordance with another embodiment of the invention.
Figure 3:
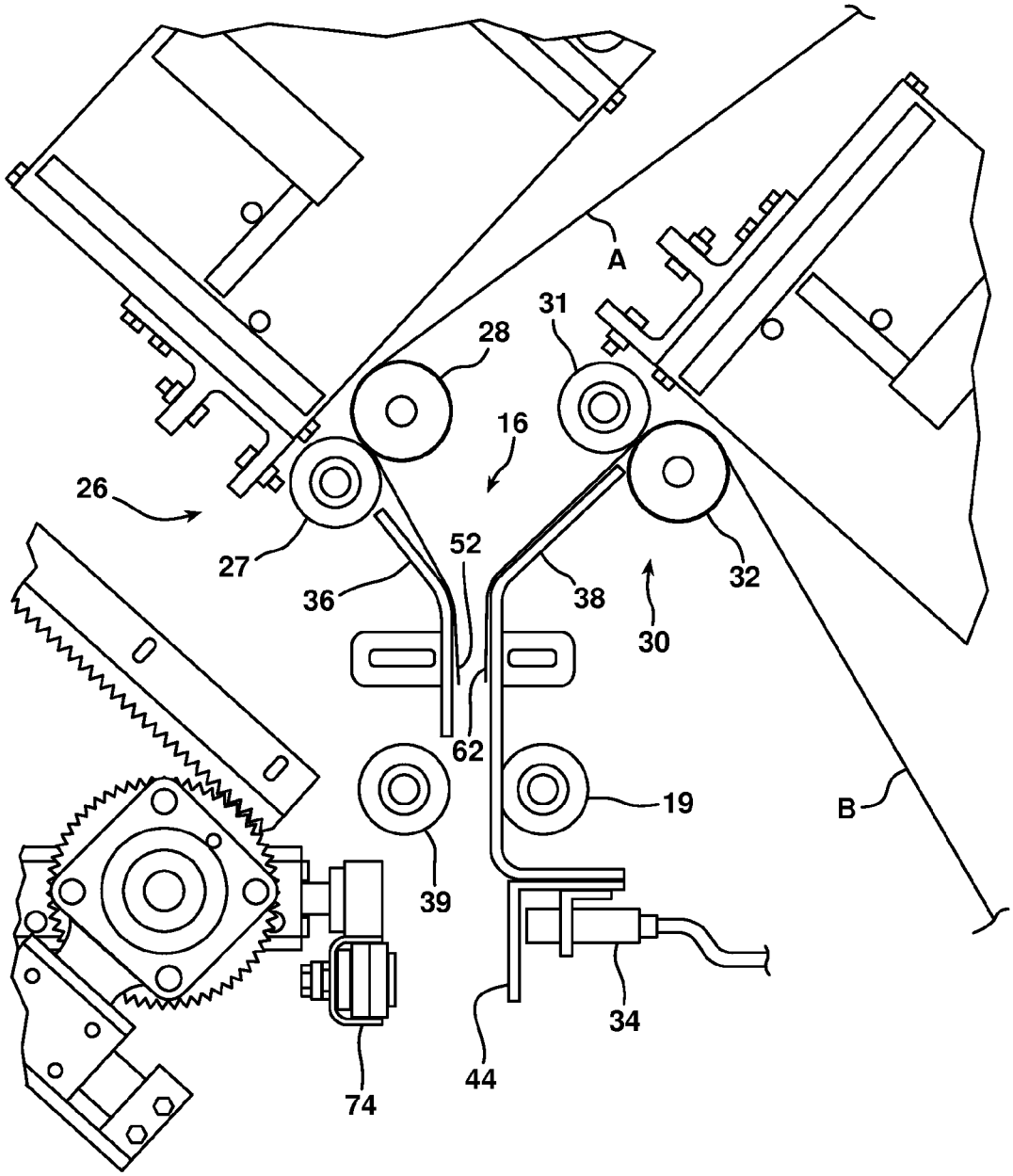
FIG. 3 is an enlarged view of a portion of the apparatus of FIG. 1.

FIGS. 1 to 3 disclose an apparatus 10 for selectively printing, accumulating, and dispensing a web from a plurality of rolls of serrated bags, each roll of bags having a series of bags connected by transverse serrations. The apparatus 10 includes a first web printer/web feeder 12, a second web printer/web feeder 14, a web accumulation area 16, a set of dispensing nip rollers 18, and a bag handling mechanism 20. The first web printer/web feeder 12 includes a printer 13, and a first set of nip rollers 26 including a moveable nip roller 27 and an anvil roller 28. The second web printer/web feeder 14 includes a printer 15, and a second set of nip rollers 30 including a moveable nip roller 31 and an anvil roller 32. The set of dispensing nip rollers 18 includes first driven fixed anvil roller 19, and second moveable nip roller 39. The apparatus also includes a web sensor 34, first and second accumulator guide plates 36 and 38 respectively, dispenser guide plate 44, first seal sensing device 70, second seal sensing device 72, first roll of serrated bags 6, second roll of serrated bags 8, and optionally a second web sensor 34*b*.

The apparatus can be used to provide discrete bags downstream to a bag handling mechanism 20 such as a bag loader.

The Process

Example 1

FIG. 1 shows the initial configuration of the apparatus in accordance with one embodiment of the invention. In a production cycle, the web of roll serrated bags A is initially manually or mechanically advanced from the first roll of serrated bags 6 and captured by the first set of nip rollers 26, i.e. captured between printer anvil roll 28 and printer nip roll 27 by a suitable mechanical actuator (not shown for the sake of clarity). The free end 52 of web A at this point extends downstream beyond the first set of nip rollers 26, but does not extend to the openable set of dispensing nip rollers 18 formed by moveable nip roller 39 and drive roller 19. The free end 52 of web A (see FIG. 3) is thus constrained between converging plates 36 and 38.

The process cycle in accordance with the invention is initiated with web A and web B positioned between the converging plates 36 and 38 as shown. The cycle is continued by advancing the desired web (either web A or web B) by driving, e.g. the free end 52 of web A with the first set of nip rollers 26, by suitable motive means (not shown for the sake of clarity) such as a motor, between the opened nip formed by moveable nip roller 39 and drive roller 19, where the web A is sensed by web sensor 34. Web sensor 34 is disposed near and downstream of dispensing nip rollers 18. The web sensor can be e.g. a photoeye or photoreflective device that senses the presence of the bag end.

When the web sensor 34 senses web A, the moveable nip roller 39 moves toward drive roll 19 whose rotation has been terminated and braking action applied by the activation of sensor 34, trapping web A between rollers 19 and 39 and stopping the free end 52 of web A in a position below the set of dispensing nip rollers 18, the web A now in a position for downstream processing.

Those of skill in the art will understand that any suitable control system (not shown for the sake of clarity) can be used to control and coordinate the various components, functions and steps of the apparatus and method of the present invention. The control system can for example include a programmable logic controller ("PLC") with suitable algorithms programmed into the PLC for the receipt and distribution of information and commands. In one embodiment, a PLC receives input from web sensor 34, and then sends a signal to move nip roller 39 toward drive roller 19, and to terminate the rotation of drive roller 19. The PLC can include a PC with a WINDOWS™ or other type operating system to provide a user-interface via mouse or keyboard. PLC-type controls offer reliability of operation in a manufacturing environment, and also offer variability in operation. The operating settings of the PLC can thus be adjusted by the equipment operator, in a relatively short time frame, to provide for e.g. web selection, change in the length of the web that is advanced in any particular cycle, and/or changes in the speed or duration of each cycle.

In one embodiment, this downstream processing can simply be the dispensing of the serrated bag forming the leading portion of the web A (see also FIG. 17), once the serration of the leading bag is broken to release the leading bag. The dispensed bag can be accepted by a human or machine operator and in some embodiments placed in a storage container, laid on a table for loading a product therein, or any number of other alternatives useful e.g. in the meat packing or food packing industry. In another embodiment, the dispensed bag can be transferred to a bag handling mechanism 20. For this latter embodiment, the bag handling mechanism 20 includes vacuum cups 74 that can engage the leading bag and transfer it to a bag loader or other downstream system. In this regard, dispenser guide plate 44 can act as a backstop or anvil against which the advanced vacuum cups 74 can contact the leading bag and then pull the bag away from the remainder of the web.

Figure 4:
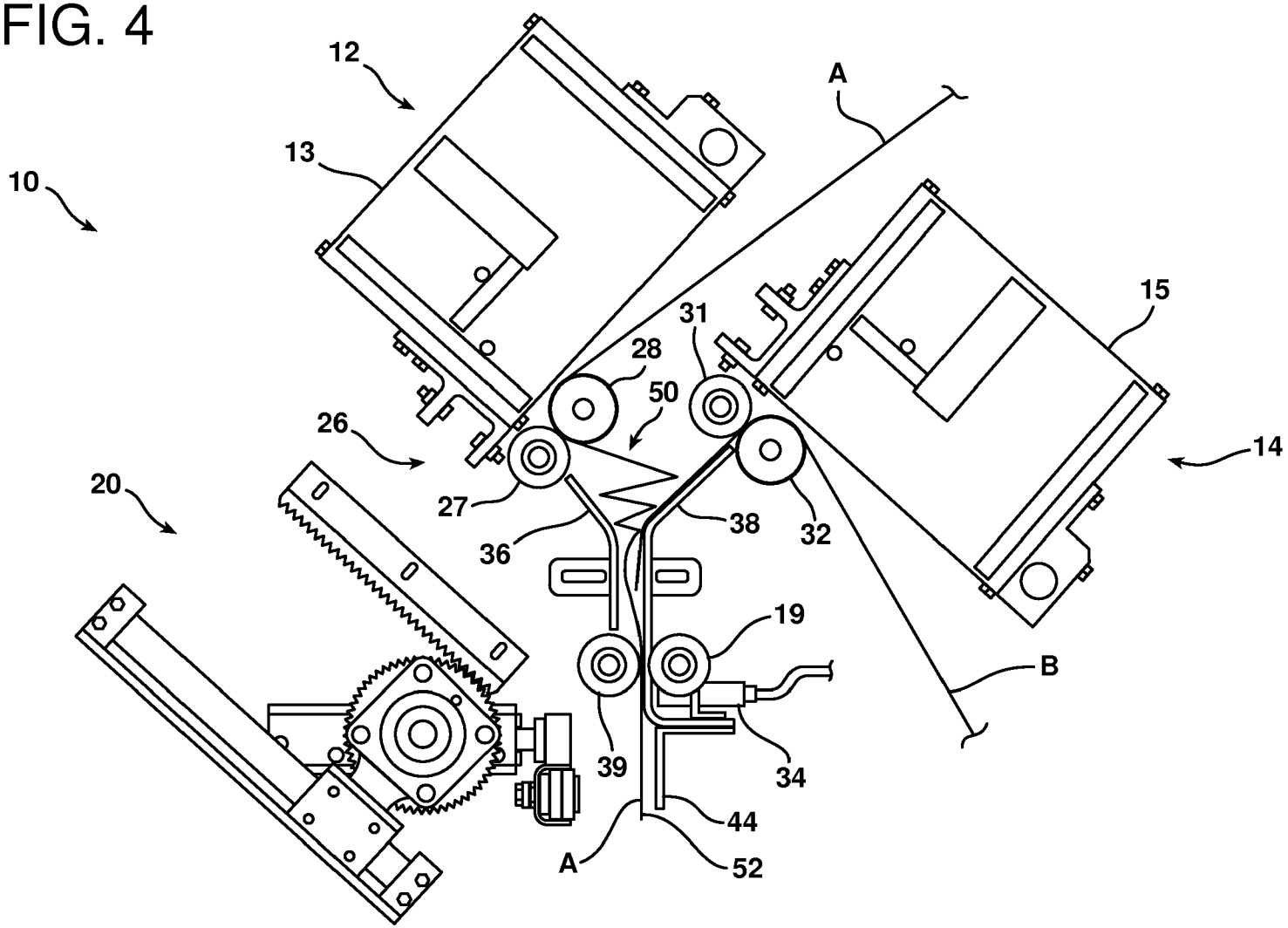
FIG. 4 is a schematic elevational view of the apparatus of FIG. 1 after printing and web accumulation is completed along a first web path.

As the free end 52 is held stationary by the clamping action of moveable nip roller 19 and drive roller 39, web A is continuously fed from the first roll of serrated bags 6, and accumulated, e.g. in a folded or shirred manner as shown in FIG. 4 as accumulated web 50, between converging plates 36 and 38 until first seal sensing device 70 has sensed the seal, serration, tab, or other feature on web A as disclosed further herein, and an appropriate amount of time has lapsed, and an appropriate additional length of web A has advanced, to ensure that the serration of the next bag, i.e. the bag immediately upstream of the leading bag, is disposed at a location downstream of the first set of nip rollers 26, but upstream of the openable set of dispensing nip rollers 18.

Example 2

In another embodiment, this process may be performed in the same way as described above for web A, first printer 13, and first set of nip rollers 26, but instead with web B, second printer 15, and second set of nip rollers 30 by activating the second set of nip rollers 30 instead of the first set of nip rollers 26.

Thus, In a production cycle, the web of roll serrated bags B is initially manually or mechanically advanced from the second roll of serrated bags 8 and captured by the second set of nip rollers 30, i.e. captured between printer anvil roll 32 and printer nip roll 31. The free end 62 of web B at this point extends downstream beyond the second set of nip rollers 30, but does not extend to the openable set of dispensing nip rollers 18 formed by moveable nip roller 39 and drive roller 19. The free end 62 of web B (see FIG. 3) is thus constrained between converging plates 36 and 38.

The process cycle in accordance with this embodiment of the invention is initiated by driving, i.e. advancing the web B with the second set of nip rollers 30, by suitable motive means (not shown) such as a motor, the free end 62 passing between the converging plates 36 and 38, then between the opened nip formed by moveable nip roller 19 and drive roller 39, where the web B is sensed by web sensor 34.

When the web sensor 34 senses web B, the moveable nip roller 19 moves toward drive roll 39, trapping web B between rollers 19 and 39 and stopping the free end 62 of web B in a position below the set of dispensing nip rollers 18, the web B now in a position for downstream processing.

As with the first example above, this downstream processing can simply be the dispensing of the serrated bag forming the leading portion of the web B (analogous to FIG. 17), once the serration of the leading bag is broken to release the leading bag. The dispensed bag can be accepted by a human or machine operator and in some embodiments placed in a storage container, laid on a table for loading a product therein, or any number of other alternatives useful e.g. in the meat packing or food packing industry. In another embodiment, the dispensed bag can be transferred to a bag handling mechanism 20.

Figure 5:
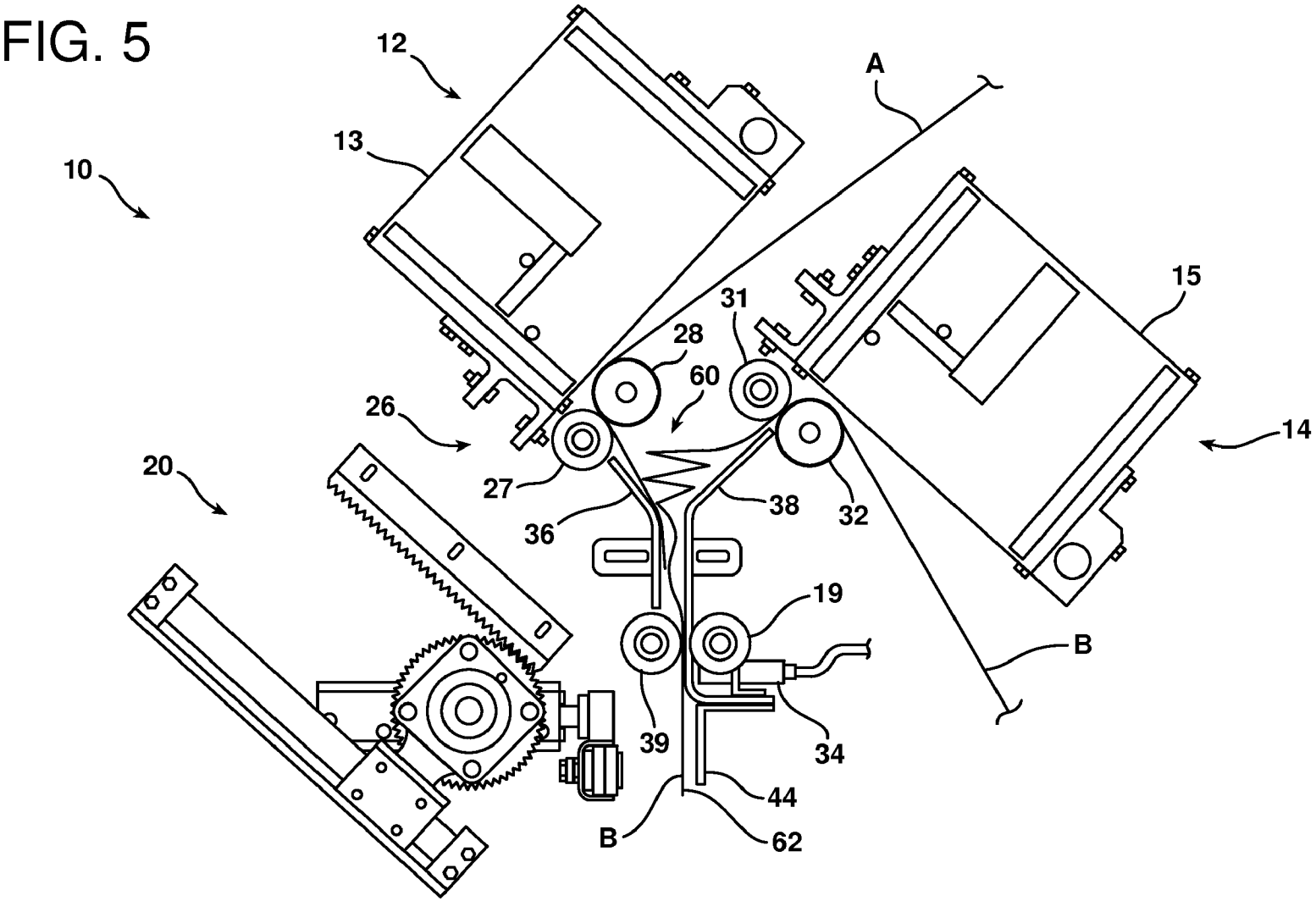
FIG. 5 is a schematic elevational view of the apparatus of FIG. 1 after printing and web accumulation is completed along a second web path.

As the free end 62 is held stationary by the clamping action of moveable nip roller 19 and drive roller 39, web B is continuously fed from the second roll of serrated bags 8, and accumulated, e.g. in a folded or shirred manner as shown in FIG. 5 as accumulated web 60, between converging plates 36 and 38 until second seal sensing device 72 has sensed the seal, serration, tab, or other feature on web B as disclosed further herein, and an appropriate amount of time has lapsed, and an appropriate additional length of web B has advanced, to ensure that the serration of the next bag, i.e. the bag immediately upstream of the leading bag, is disposed at a location downstream of the second set of nip rollers 30, but upstream of the openable set of dispensing nip rollers 18.

Webs may thus be selected on demand.

Example 3

Optionally, referring to FIG. 2, the positioning accuracy of the web free end for engagement of the vacuum cups 74 by bag handling mechanism 20 may be improved by using a first web sensor 34*a* and a second web sensor 34*b*. The second web sensor 34*b* is disposed downstream of the first set of nip rollers 26 and the second set of nip rollers 30, but upstream of the set of dispensing nip rollers 18. In this embodiment the cycle is initiated as before by driving the web with e.g. the first set of nip rollers 26, the free end 52 passing through converging plates 36 and 38, and sensed by web sensor 34*b*. After an appropriate amount of time to ensure that the free end 52 of the web A has passed through opened nips 19 and 39, nip rollers 19 and 39 are closed. Nip rollers 19 and 39 are activated, driving web A at a reduced speed until sensed by web sensor 34*a*, stopping the free end of web A in a position for transfer to bag handling mechanism 20. As the free end 52 is held stationary by nip rollers 19 and 39, web A is continuously fed and accumulated between converging plates 36 and 38 until first seal sensing device 70 has sensed the seal, serration, tab, or other feature on web A, and an appropriate amount of time has lapsed to ensure that the serration of the next bag is located between the first set of nip rollers 26, and the set of dispensing nip rollers 18. The bag free end 52 is engaged by the vacuum cups 74 of the bag handling mechanism 20 and transported away from the set of dispensing nip rollers 18, while the set of dispensing nip rollers 18 dispenses bag material that has accumulated between converging plates 36 and 38. During activation of the set of dispensing nip rollers 18 to dispense material to the bag handling mechanism 20, the first set of nip rollers 26 is inactive, allowing all accumulated material to be dispensed reestablishing tension in web A and breaking the serration previously positioned between the first set of nip rollers 26 and the set of dispensing nip rollers 18.

As indicated this configuration results in greater positional accuracy of the web free end 52. Reduced speed at the time of sensing reduces time lag elements of the systems. Having the set of dispensing nip rollers 18 closed during the sensing results in a more consistent gap between the sensor face and the web.

As before described, the process using dual web sensors 34*a* and 34*b* may be executed with a second web B by activating the second set of nip rollers 30 instead of the first set of nip rollers 26.

In each of the embodiments described herein, the bag free end is engaged by vacuum cups 74 of the bag handling mechanism 20, and transported away from the set of dispensing nip rollers 18 while the set of dispensing nip rollers 18 dispenses bag material that has accumulated between converging plates 36 and 38. For example, with respect to web A, during activation of the set of dispensing nip rollers 18 to dispense material to the bag handling mechanism 20, the first set of nip rollers 26 is inactive, thus allowing all accumulated bag material to be dispensed, and reestablishing tension in web A, and breaking the serration previously positioned at a location downstream of the first set of nip rollers 26, but upstream of the openable set of dispensing nip rollers 18.

Any appropriate printer can be used in connection with the present invention, such as a thermal transfer printer or intermittent printer. An ink jet printer may be used as an alternative to the thermal transfer printer discussed above. Thus, the web printers can be of any suitable type, such as e.g. a thermal transfer printer such as those supplied by Bellmark. Alternatively, by employing an intermittent printer (i.e. a printer that is operated in an intermittent or discontinuous manner) the print may be applied during the dwell following presentation of the web to and engagement of the web with the web transfer device 18. Although in the embodiments described herein the respective sets of upstream nip rollers are disposed adjacent the printers, alternatively there can be some distance between a set of nip rollers and the associated printer, and these respective components can be independently configured.

The accumulation area 16 is the space between the first and second accumulator guide plates 36 and 38, and the set of dispensing nip rollers 18. Webs A and B are confined in this space. The accumulation area 16 can in one embodiment also include at least a portion of the space between the first printer 13 and second printer 15. Plates 36 and 38 contain the web A and/or B in the accumulation area 16 and prevent the webs from wrapping around the anvil rollers 28 and 32 or nip rollers 27 and 31. Plates 36 and 38 also help to guide the free web ends 52 and 62 respectively down through the set of dispensing nip rollers 18. Plates 36 and 38 also allow both webs to feed consistently through the set of dispensing nip rollers 18 along a similar web path, thus allowing a single web sensor 34 to sense either web A or web B. In one embodiment, converging plates 36 and 38 together form a V-shape, but those skilled in the art will appreciate that other suitable configurations can be used as long as the respective web can be accumulated and then released during the relevant phases of the operating cycle.

The set of dispensing nip rollers 18 include a driven, fixed position anvil roller 19, and a nip roller 39 controlled by an actuator (not shown). Such actuators are well known in the art, and can be used to operate any of the nip rollers disclosed herein to move them away from or toward a companion anvil roller. Examples include pneumatic or hydraulic pistons, a gear system, or an electro-mechanical actuator.

Just below the fixed anvil roller 19, the dispenser guide plate 44 further positions the free web end 52 or 62 of webs A or B respectively for detection by the sensor 34. Guide plate 44 also helps prevent the free web end 52 or 62 from wrapping around the fixed anvil roller 19.

Webs A and B can be identical, or alternatively are different in some way. The difference can be a dimensional difference, such as width, length, or both; a compositional difference, such as the composition, thickness. or construction of each web; or any other difference that could be of benefit to a processor or packager.

To advance a specified web the appropriate set of nip rollers is closed and a drive motor (not shown) is activated in the proper direction. The apparatus is controlled in a manner to ensure only one web is nipped and advanced at any given time.

In the operation of the present invention, in embodiments where rolls of serrated bags are employed, it is beneficial to provide a way of advancing each web an appropriate distance as it feeds from the selected roll.

One way of accomplishing this is the use of printed registration marks. The use of printed registration marks is generally well known in the web handling and packaging arts.

One disadvantage of using printed registration marks is that an additional operation is required in manufacturing the roll of serrated bags. The printed registration marks must be printed in sequential fashion on each of the series of bags. This adds cost to the roll of bags.

Figure 6:
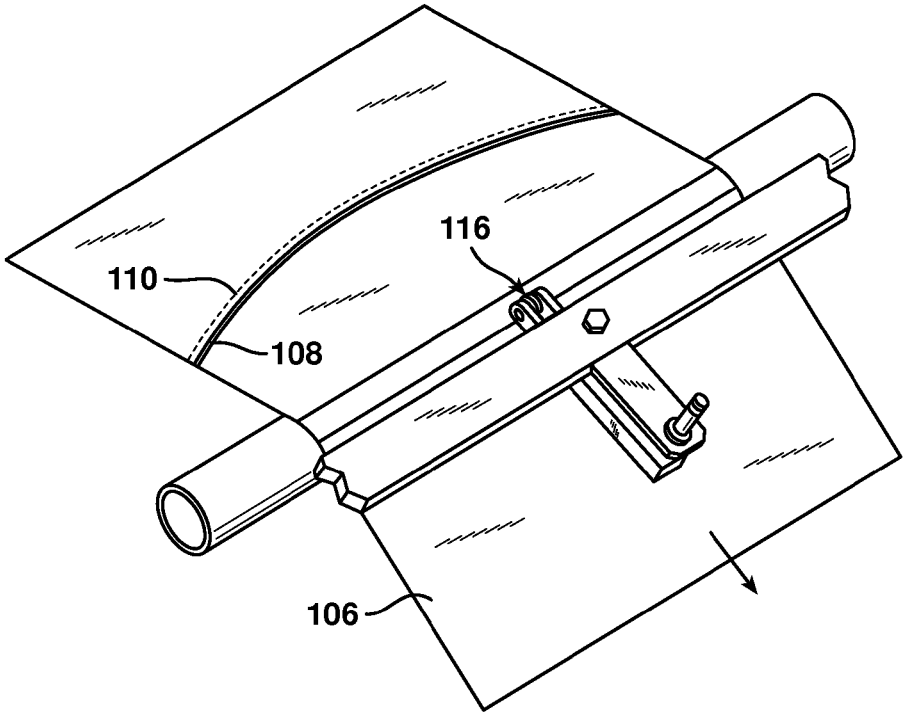
FIG. 6 is a perspective view of a device for registering roll serrated bags, for use in connection with the present invention.
Figure 7:
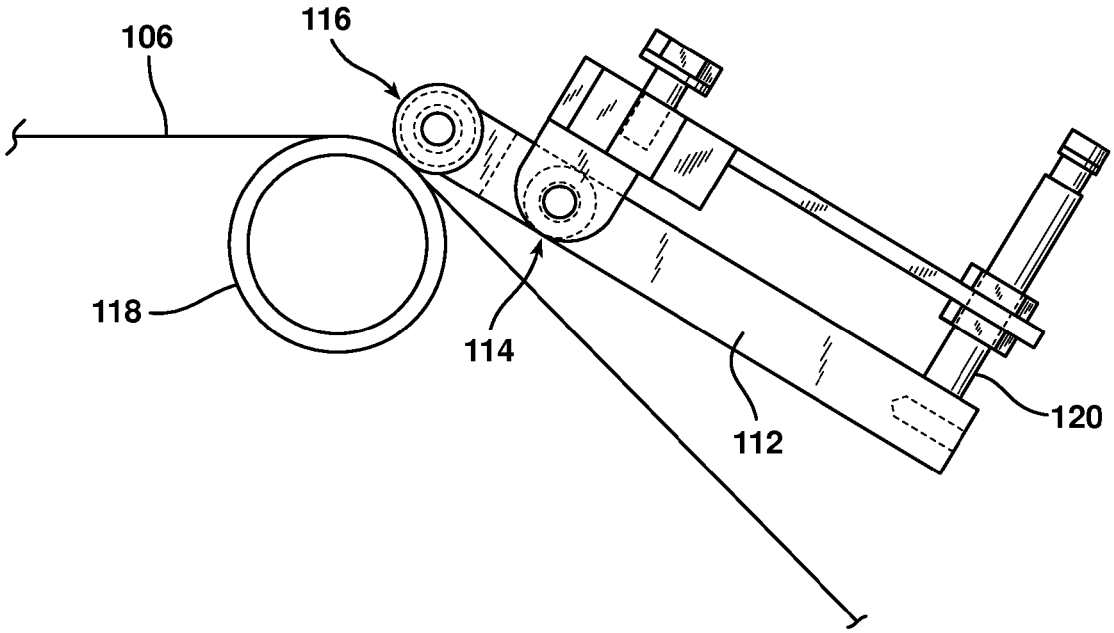
FIG. 7 is a front view of the device of FIG. 6.
Figure 8:
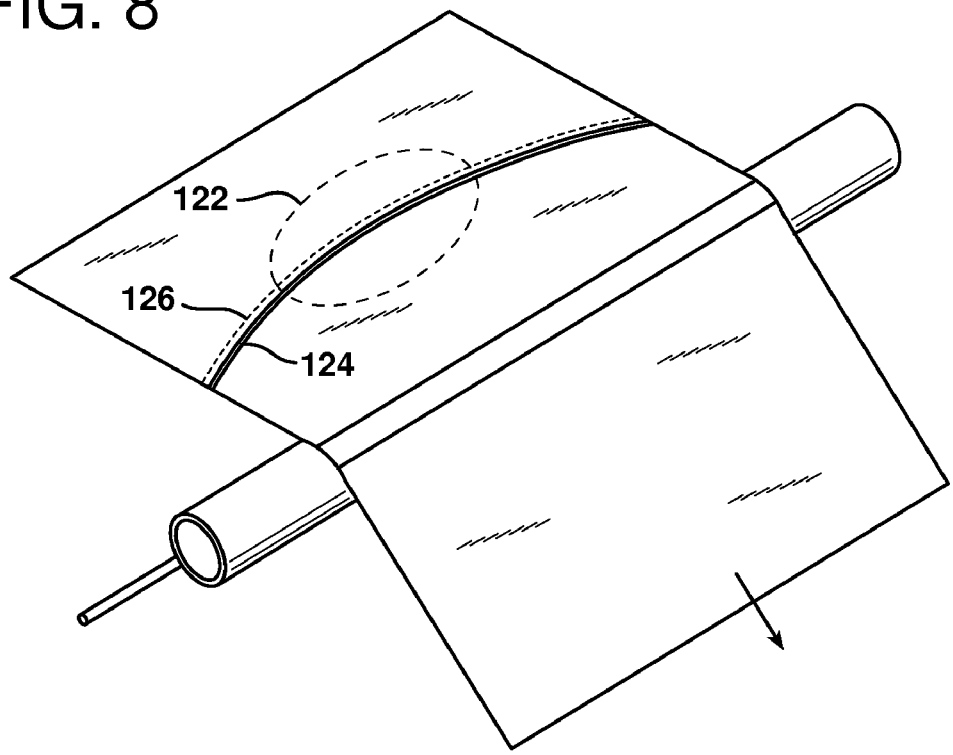
FIG. 8 is a perspective view of an alternative device for registering roll serrated bags in accordance with the present invention.

In another embodiment, and referring to FIGS. 6 and 7, each bag 106 in a roll of serrated bags includes a seal 108, which can be rectilinear or curved, and a serration 110 adjacent seal 108. Seal 108 is a different thickness than the unsealed film around it. As shown in the drawings, the machine direction, i.e. the path of travel of the bags, is such that the seal 108 precedes the serration 110; that is, the seal is positioned downstream of the serration. Alternatively, the serration 110 can precede the seal 108. Bag registration for further machine processes, such as printing, and/or separation of a bag from the next sequential bag in the series of bags, can be accomplished by sensing the rotary displacement of lever arm 112 around pivot point 114 due to the action of seal 108 displacing roller 116 away from fixed member 118. Sensing the motion of lever arm 112 is done by proximity switch 120, or other suitable motion detection device. A registration signal is thus generated as each seal passes a fixed point.

In another embodiment, and referring to FIGS. 8 to 11, each bag 122 in a roll of serrated bags includes a seal 124, which can be straight or curved, and a serration 126 adjacent seal 124. As shown in the drawings, the machine direction, i.e. the path of travel of the bags, is such that the seal 124 precedes the serration 126; that is, the seal is positioned downstream of the serration. Alternatively, the serration 126 can precede the seal 124.

Figure 9:
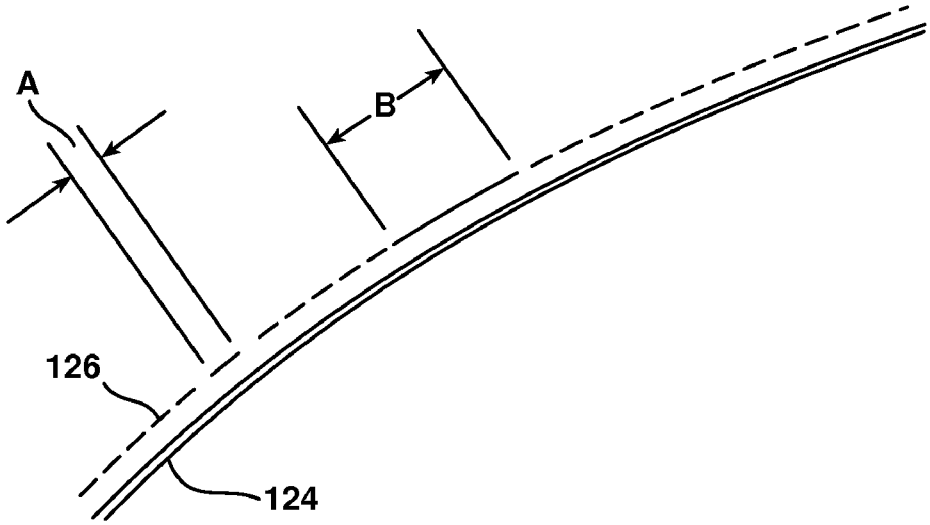
FIG. 9 is a perspective enlarged view of the encircled portion of FIG. 8.
Figure 10:
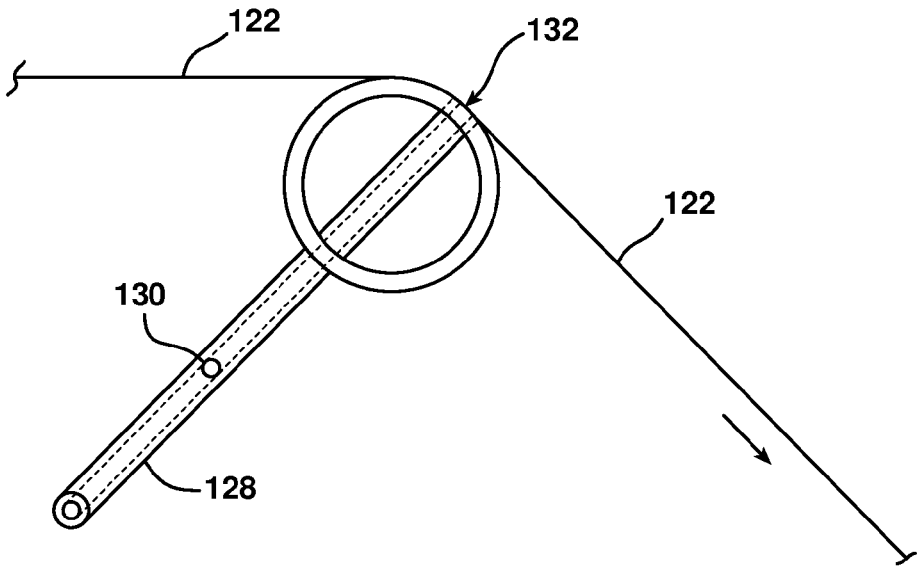
FIG. 10 is a front view of the device of FIG. 8.
Figure 12:
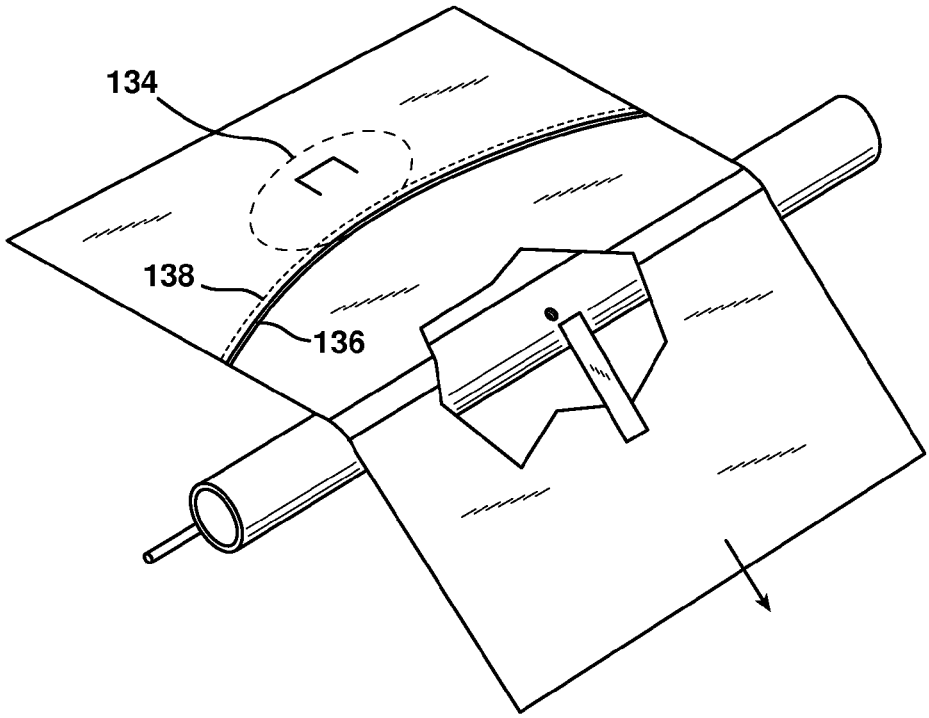
FIG. 12 is a perspective view of another alternative device for registering roll serrated bags in accordance with the present invention.
Figure 11:
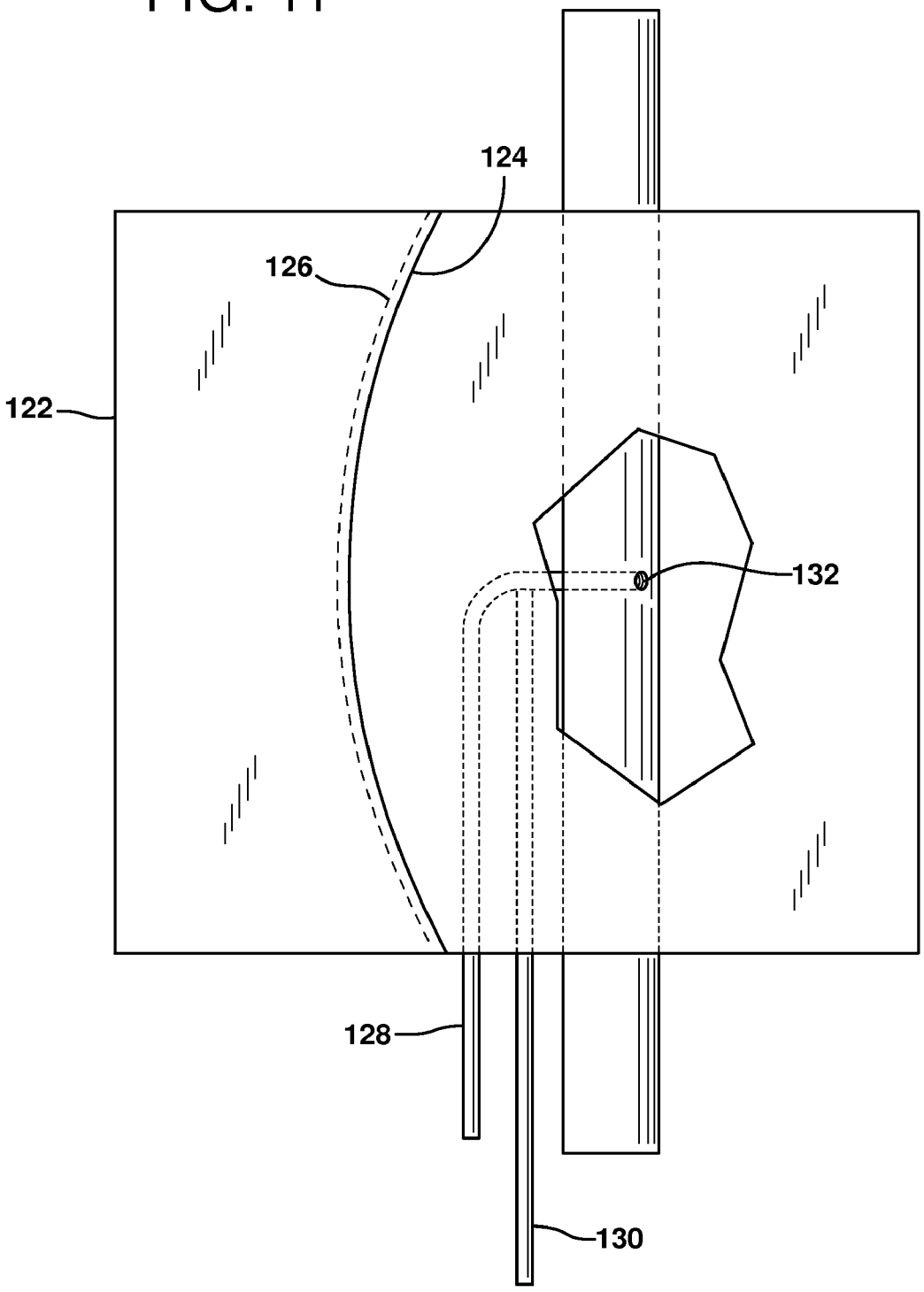
FIG. 11 is a plan view of the device of FIG. 8.

As shown in FIG. 9, serration 126 is constructed with alternated holes and bridges with dimensions of e.g. 0.25 inches for A and 1.0 inches for B. Any suitable dimensions and distribution of holes and bridges can be employed. Bag registration for further machine processes, such as printing, and/or separation of a bag from the next sequential bag in the series of bags, can be accomplished by sensing the drop in air pressure in air line 128 by means of sensing port 130 as the elongated hole portion of serration 126 passes over the exit end 132 of air line 128. A registration signal is thus generated as the serration 126 of each sequential bag passes a fixed point.

The embodiment of FIGS. 8 to 11 can be beneficially used with a variety of bag types, including patch bags, and bags without patches. An additional advantage of this embodiment is that the elongated hole portion of the serration 126 provides an opening for the release of trapped air during winding in the manufacturing process.

In yet another embodiment, and referring to FIGS. 12 to 16, each bag 134 in a roll of serrated bags includes a seal 136, which can be straight or curved, and a serration 138 adjacent seal 136. As shown in the drawings, the machine direction, i.e.

the path of travel of the bags, is such that the seal 136 precedes the serration 138; that is, the seal is positioned downstream of the serration. Alternatively, the serration 138 can precede the seal 136.

Figure 13:
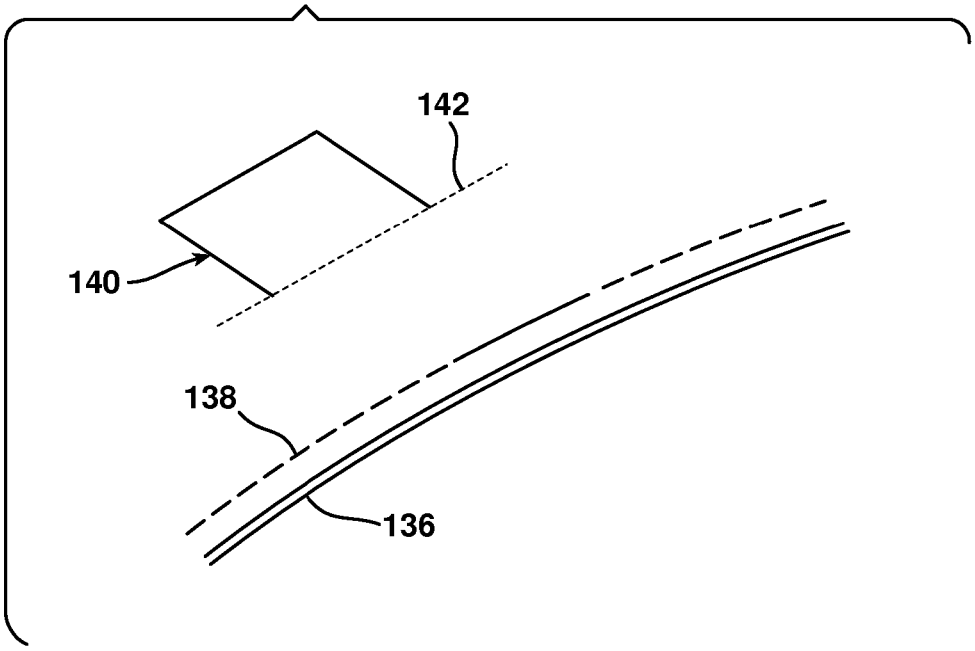
FIG. 13 is a perspective enlarged view of the encircled portion of FIG. 12.
Figure 14:
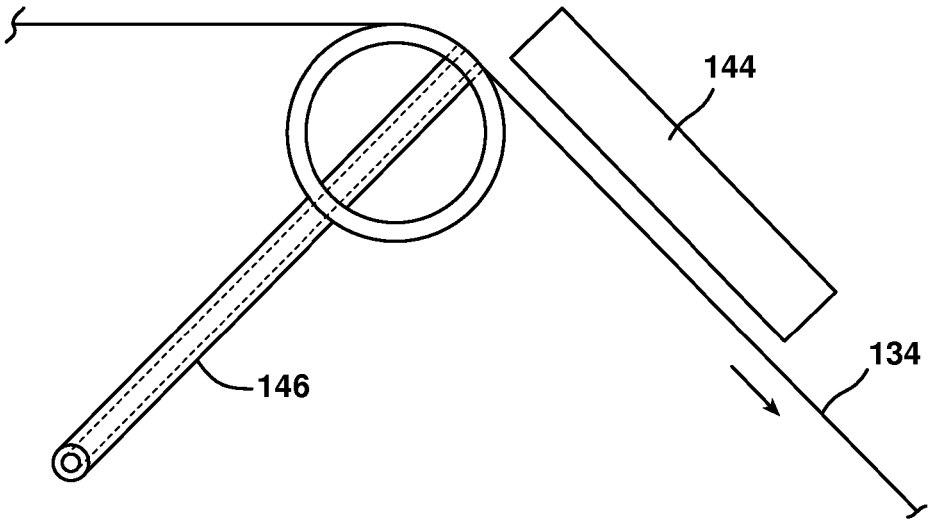
FIG. 14 is a front view of the device of FIG. 12.
Figure 15:
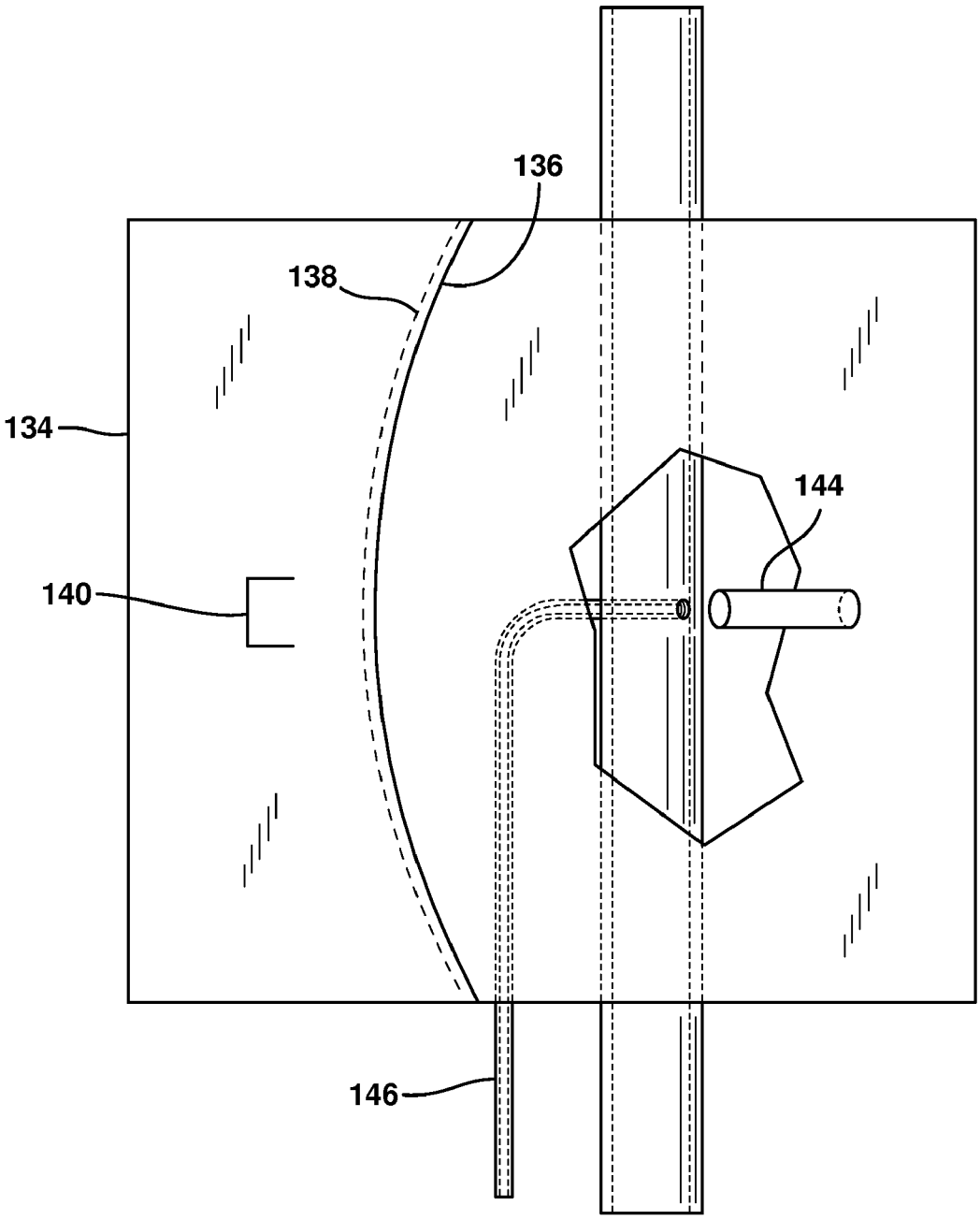
FIG. 15 is a plan view of the device of FIG. 12.
Figure 16:
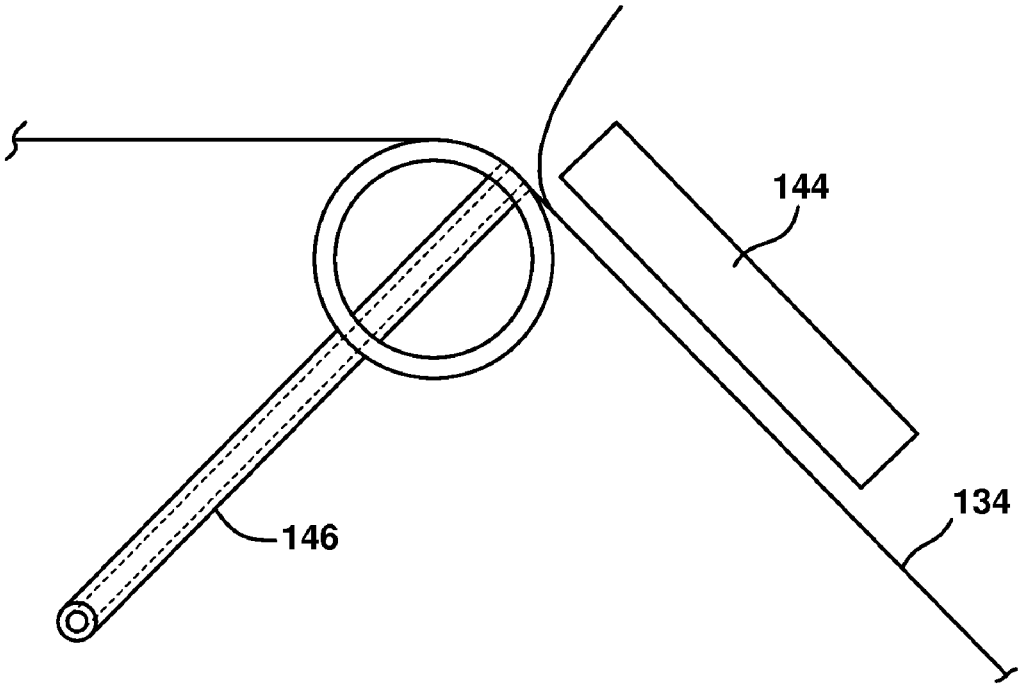
FIG. 16 is a side view of the device of FIG. 12 after a tab has reached the proximity switch of the invention.

As shown in FIG. 13, bag 134 is constructed with a through cut that forms a tab 140, which hinges around reference line 142. Although the tab 140 and reference line 142 are shown as rectangular, any suitable geometry can be employed. Bag registration for further machine processes, such as printing, and/or separation of a bag from the next sequential bag in the series of bags, can be accomplished by sensing the tab 140 with proximity switch 144 as the tab passes over the exit end of air line 146. A registration signal is thus generated. The tab 140 is sensed because the air pressure from air line 146 forces the tab above the plane of the bag 134, where the tab can be sensed by the proximity switch 144.

In another embodiment, the bag 134 can be used instead of the elongated hole portion of serration 126. Thus, as the tab 140 passes over the exit end 132, a drop in air pressure can be observed at 146.

The embodiment of FIGS. 12 to 16 can be beneficially used with a variety of bag types, including patch bags, and bags without patches. An additional advantage of this embodiment is that the through cut that forms the tab 140 provides an opening for the release of trapped air during winding in the manufacturing process.

Figure 17:
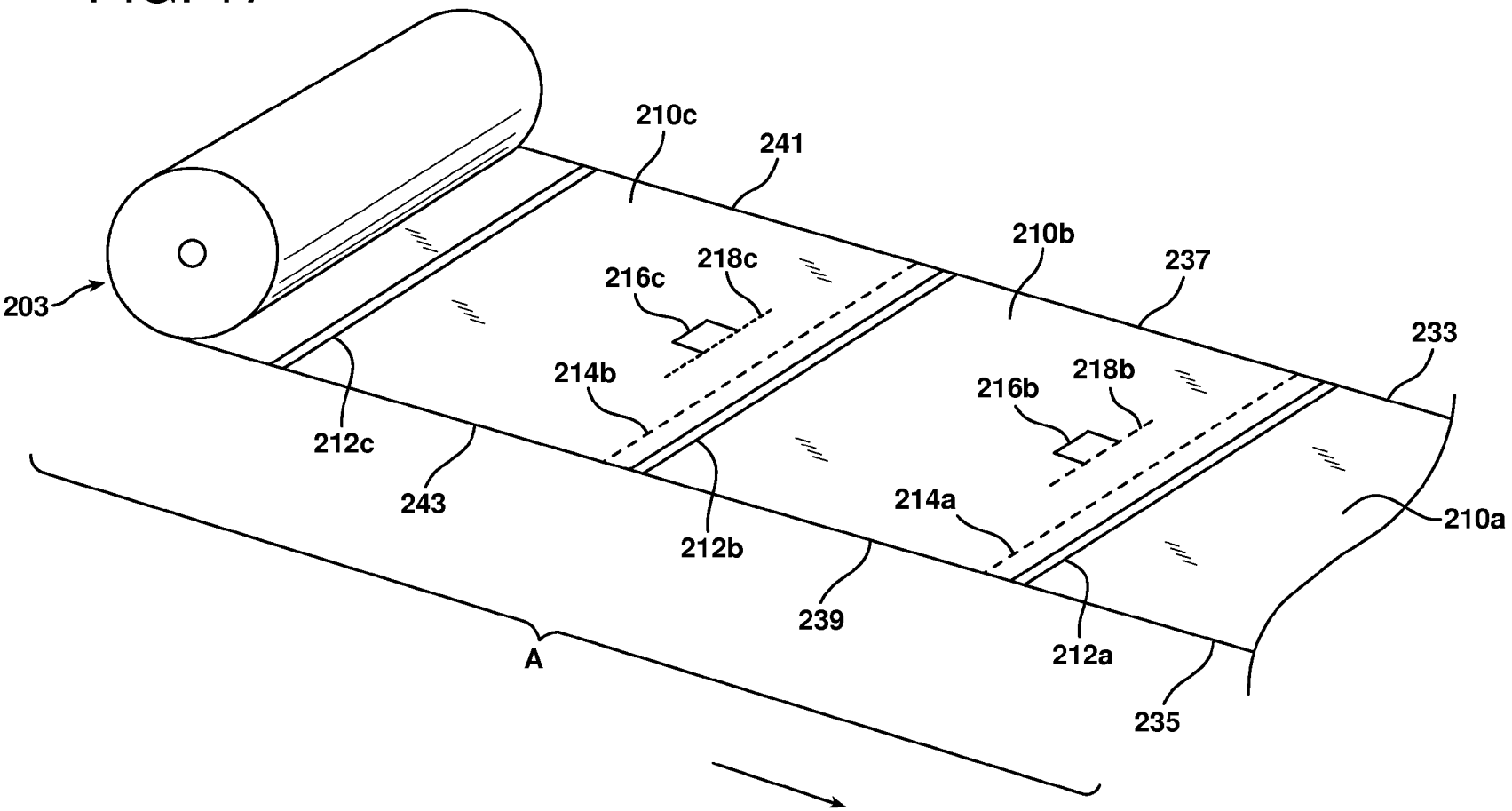
FIG. 17 is a perspective view of a roll of serrated bags with a web in accordance with the invention.

FIG. 17 discloses a roll 203 of serrated bags with a web in accordance with one embodiment of the invention. Web A is a leading portion of a plurality of serrated bags drawn from roll 203. A portion of a leading bag 210*a* is shown toward the right side of the drawing. This leading bag can be separated from the web A in accordance with the invention by downstream operations described herein. Bag 210*a* has a transverse seal 212*a*. Bag seals are in general heat seals, although any suitable seal can be used in accordance with the invention. Although bags in accordance with the invention are beneficially end seal bags, the invention can be used in connection with side seal bags. Thus, the first side 233 and second side 235 of bag 210*a* are, in the case of end seal bags, each made up of a bag fold. The bag upstream and adjacent to bag 210*a* is bag 210*b*, similarly configured with transverse seal 212*b*, and first side 237 and second side 239. Bag 210*b* also has a serration 214*a*, a tab 216*b*, and a reference line 218*b* indicating the line of attachment of tab 216*b* to bag 210*b*. The bag upstream and adjacent to bag 210*b* is bag 210*c*, similarly configured with transverse seal 212*c*, and first side 241 and second side 243, Bag 210*c* also has a serration 214*b*, a tab 216*c*, and a reference line 218*c*.

In alternative embodiments of the present invention, a seal bar can be incorporated above at least one of the web printer/web feeders 12 or 14, and can include an intermediate knife system. This would be useful where the web is in the form of a lay flat tube. Thus, at least one of the webs A or B can comprise a lay-flat tubing instead of a leading portion of a roll of serrated bags. The seal bar, which can be an impulse or continuous heat seal bar of the type well known in the art, can be used in conjunction with a conventional knife to create a transverse heat seal across the lay flat tubing to define a leading bag. The bag can then be printed and advanced as taught herein.

The apparatus of the invention can be arranged in any suitable orientation or configuration, from vertical to horizontal, provided the various components of the apparatus operate as described herein. Thus, variations in orientation are possible and contemplated herein.

The invention provides a solution to the problem of how to select from multiple bag sources, print and advance discrete bags. The invention also allows the union of two independent processes (printing and downstream automated bag handling) running at different speeds, combined into one continuous system.

The invention allows more than one process to be combined into a system by providing a buffer between processes that occur at different rates.

Problem resolution is achieved in a compact module. Utilizing rolls of serrated bags, the location of the web free ends are in some embodiments initially in close proximity, thus, selection, printing, accumulation and dispensing require very little space.

The invention uses rolls of serrated bags that typically have less seal pucker and wrinkles than taped bags, providing a flatter, more uniform surface for applying print.

The invention allows the printer's anvil roll to be used as a driven nip roll as opposed to just an idler roll. This allows the printer to be located in close proximity to the web free end, thereby increasing the printable area of the bag.

The invention allows both webs to be sensed by a single device.

By dispensing both webs to a common location, this invention allows a wide variety of downstream devices to use the bag.

Thermoplastic films such as olefinic films with or without oxygen barrier functionality, can be used with benefit in this invention. These films are made by extrusion coating, coextrusion, lamination, or other suitable processes. For many applications, films comprising an outer layer, an intermediate layer, and an inner layer are beneficial. The materials of the outer layer are often chosen for abuse resistance and/or sealability, and can be chosen from any suitable polymeric materials such as polyolefins, e.g. ethylenic polymer and copolymer, polypropylene, polyester, polyamide, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Examples include polyvinylidene chloride polymer and copolymer, ethylene vinyl alcohol copolymer, polyvinyl alcohol, polyamide, polyester, acrylonitrile, and the like. Bags can be heat shrinkable, and can be at least partially crosslinked.

The webs can be printed with indicia such as a trademark (word and/or logo), information related to the ultimate contents of the bag to be formed from the web, codes relating to the production facility, etc., using any suitable inks, and any suitable designs or patterns.

It is to be understood that variations of the present invention can be made without departing from the scope of the invention, which is not limited to the specific embodiments and examples disclosed herein, but extends to the claims presented below.

For example, although two webs A and B are shown herein, along with first web printer/web feeder comprising a first printer, and a first set of nip rollers; a second web printer/web feeder comprising a second printer, and a second set of nip rollers, in one embodiment more than two webs can be beneficially used in connection with the present invention. For each additional web used, an additional web printer/web feeder would be used.

What is claimed is:

1. An apparatus for selectively dispensing a web from a plurality of rolls of serrated bags, each roll of bags having a series of bags connected by transverse serrations, the apparatus comprising:

a) first web printer/web feeder, adapted to advance and print a first web from a first roll of serrated bags, the first web printer/web feeder comprising i) a first printer, and ii) a first set of nip rollers;

b) a second web printer/web feeder, adapted to advance and print a second web from a second roll of serrated bags, the second web printer/web feeder comprising
i) a second printer, and
ii) a second set of nip rollers,
the second printer spaced apart from the first printer;

c) first and second accumulator guide plates located downstream of the first and second printers, the second accumulator guide plate spaced apart from the first accumulator guide plate;

d) a set of dispensing nip rollers located downstream of the first and second accumulator guide plates;

e) a web accumulation area defined by the space between the first and second accumulator guide plates, and the set of dispensing nip rollers, f) a control system configured to control the first and second set of nip rollers and the dispensing nip rollers to accumulate the first web in the web accumulation area or to accumulate the second web in the web accumulation area;

g) a web sensor for sensing an end of the first web, or an end of the second web;

h) a first seal sensing device for sensing a bag serration, seal; or tab of the first web;

i) a second seal sensing device for sensing a bag serration, seal; or tab of the second web;

l) a dispensing guide plate located downstream of the sensor; and k) a bag handling mechanism for advancing a leading bag to a bag loader.

2. The apparatus of claim 1 wherein the first and second set of nip rollers each comprises a moveable nip roller and a driven anvil roller.

3. The apparatus of claim 1 wherein the first and second accumulator guide plates are arranged in a V-shape.

4. The apparatus of claim 1 wherein the web accumulation area is defined by the space between the first and second printers, the space between the first and second accumulator guide plates, and the set of dispensing nip rollers.

5. The apparatus of claim 1 wherein the first and second seal sensing devices each comprises a sensor that operates by sensing the rotary displacement of a lever arm around a pivot point due to the action of a seal displacing a roller away from a fixed member.

6. The apparatus of claim 1 wherein the first and second seal sensing devices each comprises a sensor that operates by sensing the drop in air pressure in an air line by means of a sensing port as a hole portion of a serration passes over an exit end of the air line.

7. The apparatus of claim 1 wherein the first and second seal sensing devices each comprises a sensor that operates by the use of a through cut that forms a tab in the web, wherein the tab is sensed with a proximity switch as the tab passes over the exit end of an air line as air pressure from the air line forces the tab above the plane of the web, where the tab can be sensed by the proximity switch.

8. The apparatus of claim 1 wherein the set of dispensing nip rollers comprises a driven anvil roller having a fixed position, and a moveable nip roller.

9. The apparatus of claim 1 wherein the dispensing guide plate is L-shaped.

10. The apparatus of claim 1 further comprising a second web sensor disposed downstream of the first and second set of nip rollers, and upstream of the set of dispensing nip rollers.

11. A method of selectively dispensing a web from a plurality of rolls of serrated bags, each roll of bags having a series of bags connected by transverse serrations, the method comprising:

a) selecting and advancing a first web from a first roll of serrated bags, the first web having a free end, and a leading bag with a serration therein;

b) advancing the first web between a first set of nip rollers, the first set of nip rollers comprising a moveable nip roller and a driven anvil roller;

c) printing indicia on the first web;

d) advancing the printed web between a first accumulator guide plate and a second accumulator guide plate;

e) drawing the printed web between a set of dispensing nip rollers located down-stream of the first and second accumulator guide plates;

f) sensing the web by a web sensor disposed near and downstream of the set of dispensing nip rollers;

g) moving the moveable nip roller toward the driven anvil roller;

h) trapping the first web between the moveable nip roller and the driven anvil roller;

i) stopping the free end of the first web in a position below the set of dispensing nip rollers;

j) advancing an additional length of the first web from the first roll of serrated bags; and k) accumulating the advanced web between the first and second accumulator guide plates in an accumulation area, until a first seal sensing device, positioned upstream of the first set of nip rollers, has sensed a seal, serration, or tab, on the first web, and a sufficient length of the first web has advanced, to ensure that the serration of the bag immediately upstream of the leading bag is disposed at a location downstream of the first set of nip rollers, but upstream of the set of dispensing nip rollers.

12. The process of claim 11 wherein the first and second accumulator guide plates are arranged in a V-shape.

13. The process of claim 11 wherein the first seal sensing device senses the rotary displacement of a lever arm around a pivot point as a seal displaces a roller away from a fixed member.

14. The process of claim 11 wherein the first seal sensing device senses the drop in air pressure in an air line by means of a sensing port as a hole portion of a serration passes over an exit end of the air line.

15. The process of claim 11 wherein the first seal sensing device comprises a sensor that operates by the use of a through cut that forms a tab in the web, wherein the tab is sensed with a proximity switch as the tab passes over the exit end of an air line as air pressure from the air line forces the tab above the plane of the web, where the tab is sensed by the proximity switch.

16. The process of claim 11 wherein the set of dispensing nip rollers comprises a driven anvil roller having a fixed position, and a moveable nip roller.

17. The process of claim 11 comprising a dispensing guide plate.

18. The process of claim 11 further comprising a second web sensor disposed downstream of the first set of nip rollers, and upstream of the set of dispensing nip rollers.

* * * * *